United States Patent [19]

James

[11] 4,203,694

[45] May 20, 1980

[54] SQUARING REAMS OF PAPER FOR WRAPPING

[75] Inventor: Robert C. James, Sheboygan, Wis.

[73] Assignee: Hayssen Manufacturing Company, Sheboygan, Wis.

[21] Appl. No.: 905,634

[22] Filed: May 15, 1978

[51] Int. Cl.[2] ..... B65H 9/10

[52] U.S. Cl. ..... 414/28; 198/434; 198/456; 271/184

[58] Field of Search ..... 214/65, 152; 271/184, 271/210, 225, 238, 240, 250, 251; 198/456, 434; 100/3; 93/36 SQ, 93 DP; 414/28, 36, 786

[56] References Cited

U.S. PATENT DOCUMENTS

| | | | |
|---|---|---|---|
| 2,128,316 | 8/1938 | Paul | 214/65 X |
| 2,277,511 | 3/1942 | Daneke | 271/210 |
| 2,617,647 | 11/1952 | Davis | 271/225 X |
| 2,937,485 | 5/1960 | Wall | 214/65 X |
| 3,225,684 | 12/1965 | Smith | 100/3 X |
| 3,361,426 | 1/1968 | Pawlikowski et al. | 271/250 X |
| 3,561,578 | 2/1971 | Goodwin et al. | 193/32 |
| 3,866,906 | 2/1975 | Berry | 271/250 X |
| 4,014,539 | 3/1977 | Goodwin | 271/225 X |

FOREIGN PATENT DOCUMENTS

| | | | |
|---|---|---|---|
| 655937 | 1/1963 | Canada | 271/250 |

*Primary Examiner*—L. J. Paperner

*Attorney, Agent, or Firm*—Senniger, Powers, Leavitt and Roedel

[57] ABSTRACT

Method of and apparatus for squaring reams of paper as they are fed toward a wrapper, the squaring up being accomplished as the reams are moving forward toward the wrapper.

4 Claims, 5 Drawing Figures

SQUARING REAMS OF PAPER FOR WRAPPING

BACKGROUND OF THE INVENTION

This invention relates to the wrapping of reams of paper, and more particularly to a method of and apparatus for squaring reams of paper as they are being fed to a wrapper wherein they are wrapped in a sheet of wrapping paper.

The invention is directed particularly to the wrapping of reams of paper, such as 8½" by 11" sheets of paper (a ream consisting of 500 sheets of the paper). Such reams are presently produced in vast quantities by means of an apparatus called a "sheeter", which cuts paper into sheets of the desired size (e.g., 8½" by 11") and stacks up the sheets in reams of 500 sheets. The reams are then fed to a wrapper, wherein they are wrapped in a sheet of wrapping paper. Since each ream is a loose stack of sheets, the sheets may become out of register (sometimes referred to as "out of jog") in the course of their travel from the sheeter to the wrapper, and this is undesirable since it is preferable to have each ream in nicely squared condition as it is wrapped.

SUMMARY OF THE INVENTION

Accordingly, among the several objects of this invention may be noted the provision of a method of and apparatus for squaring reams of paper as they are fed to a wrapper; and the provision of a method of and apparatus for squaring the reams without slowing down the rate of feed of the reams to the wrapper (which is relatively high) so as not to slow down the production of wrapped reams.

In general, the method of the invention is carried out in the wrapping of reams of paper wherein the reams are fed forward one after another to a wrapping apparatus and wherein the sheets in a ream may be out of register, the reams being fed forward with two opposite sides of each ream extending generally in the direction of feed and the other two opposite sides extending generally transversely of the direction of feed, and involves subjecting each ream as it is fed forward to force applied in the direction from one side of the ream to the other to cause the sheets of the ream which may be out of register to become registered so as to square up the ream. The apparatus of the invention involves means for subjecting each ream to such force.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
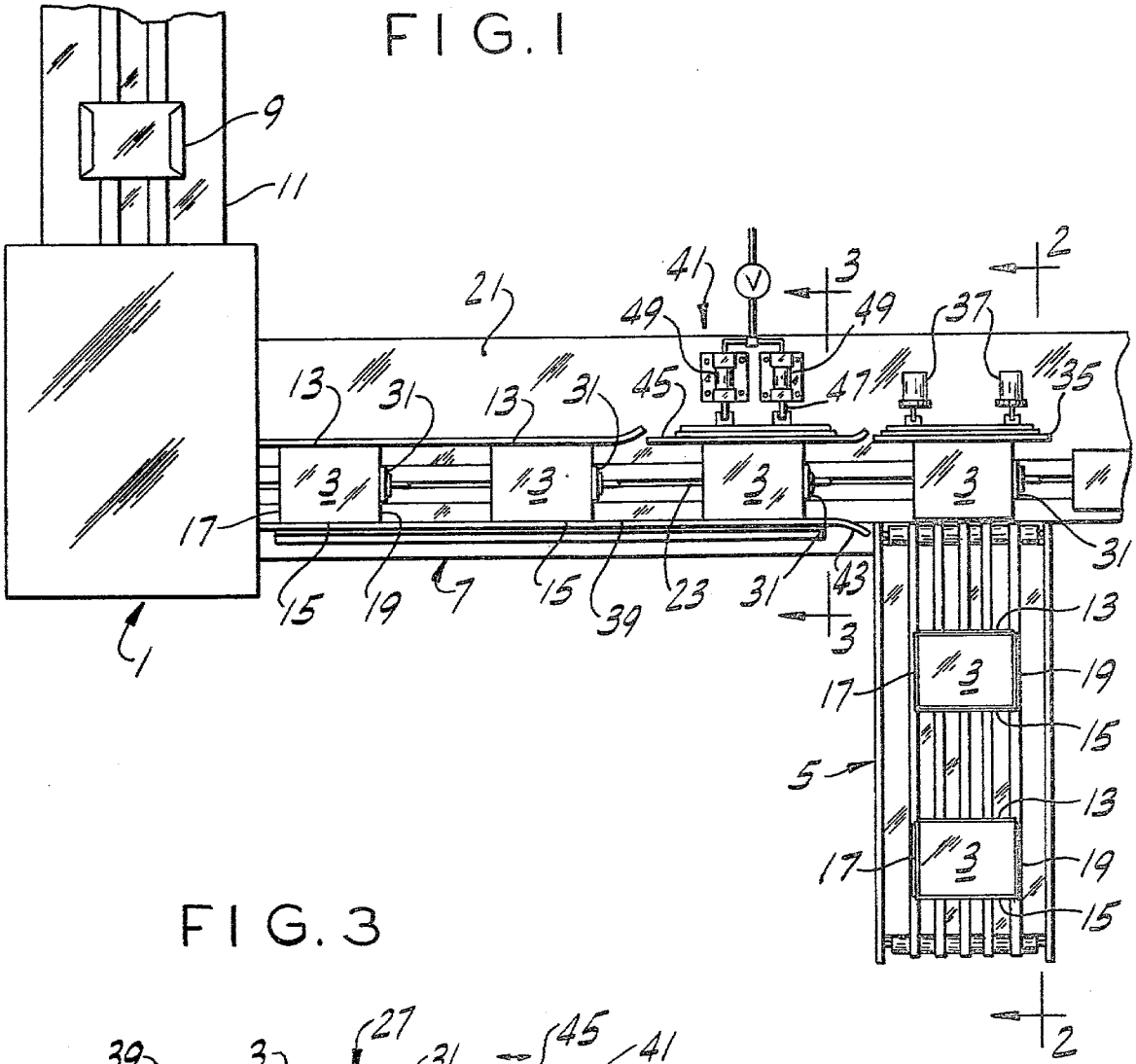
FIG. 1 is a view showing in plan a wrapper and apparatus of this invention for squaring reams of paper as they are fed to the wrapper.

Referring to FIG. 1 of the drawings, there is generally indicated at 1 a wrapper to which reams 3 of paper are fed for being wrapped. The reams 3 are shown as being fed to the wrapper by first and second conveyors 5 and 7. The wrapped reams, one of which is indicated at 9, are fed away from the wrapper by an outfeed conveyor 11. The first conveyor 5, which is a belt conveyor, receives reams 3 as they are produced by a sheeter (not shown) and delivers them to the second conveyor 7. The reams 3 being fed forward by the conveyor 5 and delivered to conveyor 7 may be out of register ("out of jog"), i.e., the edges of all the sheets in the ream may not be lined up with one another. Associated with the conveyor 7, as will appear, is means of this invention for squaring up any reams which may need squaring up before they enter the wrapper.

The wrapper 1 may be of any suitable well-known type for applying a sheet of wrapping paper around a product which has the form of a rectangular parallelepiped. Reference may be made to the coassigned U.S. Pat. No. 3,861,120 issued Jan. 21, 1975 for a disclosure of such a wrapper. Conveyor 7 delivers the reams to the wrapper (from the right as viewed in FIG. 1). Conveyors 5 and 7 are at right angles to one another. Conveyor 11 feeds out of wrapper 1 at right angles to conveyor 7 with the conveyors in a "Z" arrangement as shown. They may be in a "U" arrangement.

The conveyor 7 constitutes means for feeding the reams forward one after another to the wrapper with two opposite sides 13 and 15 of each ream extending generally in the direction of feed and the other two opposite sides 17 and 19 extending generally transversely to the direction of feed. As illustrated in FIG. 1, the reams are rectangular, 13 and 15 being the long sides and 17 and 19 being the shorter sides. In the case of reams of 8½" by 11" sheets, sides 13 and 15 would be the 11" sides and sides 17 and 19 would be the 8½" sides. The reams are fed forward on conveyor 5 with the long sides 13 and 15 transverse to the direction of feed of conveyor 5 and the short sides 17 and 19 extending in the direction of feed. With conveyor 7 extending at right angles to conveyor 5, the reams as delivered by conveyor 5 to conveyor 7 become oriented with their long sides 13 and 15 extending in the direction of feed of 7 and their short sides 17 and 19 extending transversely of the direction of feed of 7.

The conveyor 7 is a flight conveyor comprising an elongate table 21 providing a stationary surface over which the reams 3 may be pushed (lengthwise of the table) toward the wrapper 1. The table has a longitudinal slot 23. The conveyor 7 further comprises an endless conveyor means 25 having flights 27 spaced at equal intervals along its length, this conveyor means having an upper reach **25*a*. The flights 27 have arms 29 extending up from the upper reach through the slot 23 in the table with pusher plates 31 on the ends of the arms above the surface of the table for pushing the reams forward on the table. The pusher plates, the tops of which extend above the reams so as to ensure that the plates engage the upper sheets of the reams (see FIG. 3), may be inset in a channel 33 in the table so that the plates are certain to engage the lower sheets of the reams. The pusher plates are spaced at intervals greater than the length of the reams, as is apparent from FIG. 1**.

Conveyor 5 delivers reams to the conveyor 7 at relatively high speed (e.g., 90 reams per minute corresponding to a wrapping rate of 90 reams per minute) from the left side of the conveyor 7 as viewed looking toward the wrapper (i.e., downstream of conveyor 7) being timed in relation to conveyor 7 to deliver each ream between two successive pusher plates 31 of conveyor 7. Each ream, as delivered to conveyor 7 by conveyor 5, is fed (at relatively high speed) transversely across the table 21 from left to right, and the leading side of the ream, which here is its side 13, strikes a stop 35 constituted by a vertical plate extending longitudinally of the table on the right side of the path of the pusher plates 31 of the endless conveyor means 25 to arrest the ream in the appropriate lateral position for its ongoing travel on the table 21 toward the wrapper 1. The stop plate 35 is carried by shock absorbers 37, which may be conventional air or liquid dashpot type shock absorbers, allowing for cushioning of the impact of the ream against the stop plate. This impacting of the ream against the stop plate may tend to effect some realignment transversely of the ream of the sheets in the ream which may have gotten out of alignment.

After delivery by conveyor 5 of each ream 3 to the conveyor 7, with arrest of the ream against the stop plate 35, the ream is pushed forward on the table 21 by a pusher plate 31 of the endless conveyor means 25. As it is fed forward, it passes between a guide 39 extending in the direction of feed at one side of the table (its left side as viewed in downstream direction) and a means indicated generally at 41 for applying force to the ream at the opposite side with the force in the transverse direction toward the guide 39, so that any sheets of the ream which may be out of register attain register in the transverse direction against the guide 39. The latter comprises a stationary vertical plate extending longitudinally of the table 21 on the left side of the path of the pusher plates 31 located for engagement by the left side 15 of a ream as the ream is pushed forward from its position as initially delivered to the conveyor 7, the plate 39 having an outwardly curved rear end 43 for guiding the left side of the ream into engagement with the elongate straight inside face of the plate 39.

Figure 2:
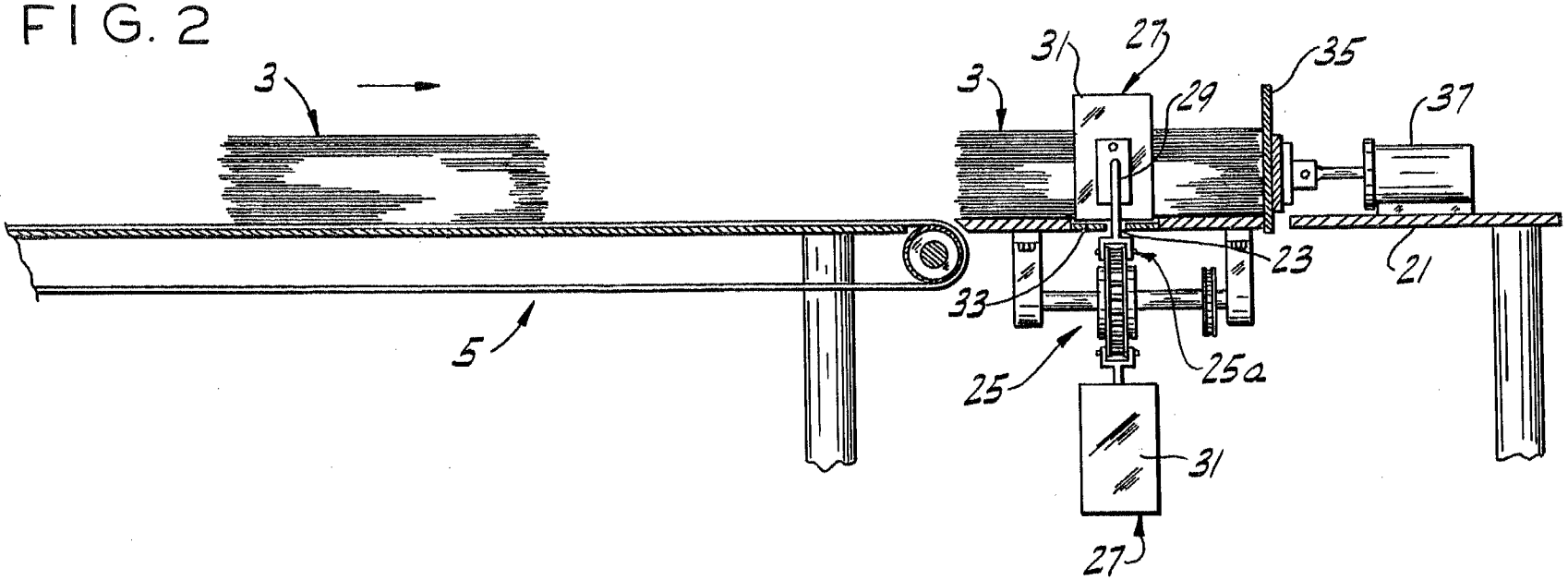
FIG. 2 is a view in elevation and vertical section on line 2—2 of FIG. 1, on a larger scale than FIG. 1.

The force-applying means 41 is located immediately downstream from the stop plate 35 and comprises a vertical plate 45 engageable with the right side (the side 13) of a ream as it is pushed forward on the table 21 toward the wrapper 1, with this plate 45 being repetitively movable transversely of the direction of feed toward and away from the guide plate 39 for tapping the side 13 of the ream opposite the guide plate to cause any sheets of the ream that may be out of register to attain register against the guide plate. The plate 45 may be reciprocated or oscillated in any suitable manner. As shown in FIGS. 1 and 2, plate 45 is mounted on the piston rods 47 of short stroke air cylinders such as indicated at 49, which are controlled by an air valve 51 suitably actuated to effect operation of the cylinders to reciprocate the piston rods and hence the plate 45.

As each ream 3 is pushed along the table 21 by a pusher plate 31 and passes between the plate 45 and the guide 39, the plate 45 functions repetitively to tap the right side 13 of the ream, and this brings whatever sheets of the ream may have been out of transverse register back into transverse register by bringing their left side edges 15 into engagement with the guide 39. Any sheets which may have been out of register in the longitudinal direction (i.e., in the direction of feed of the ream by conveyor 7 toward the wrapper) are brought back into longitudinal register against the pusher plate 31 which is pushing them, the tapping of the sheets facilitating this action, which appears to occur as a result of frictional resistance to the forward movement of the sheets against the guide 39 and the plate 45, resulting in what is in effect a rearward force on the sheets tending to bring them back against the pusher plate 31.

The above-described squaring of the reams is particularly applicable to reams produced by a sheeter. It is believed that, in the stacking of the sheets to form a ream in the sheeter, some air remains between the sheets, and this acts to reduce the friction that would otherwise occur between the sheets, making it easier for one sheet to slide relative to another into register. It is contemplated that the travel of the reams over the table 21 may be facilitated by making the table an air table in conventional manner, providing for sliding of the reams along the table on a cushion of air as will be readily understood.

Figure 3:
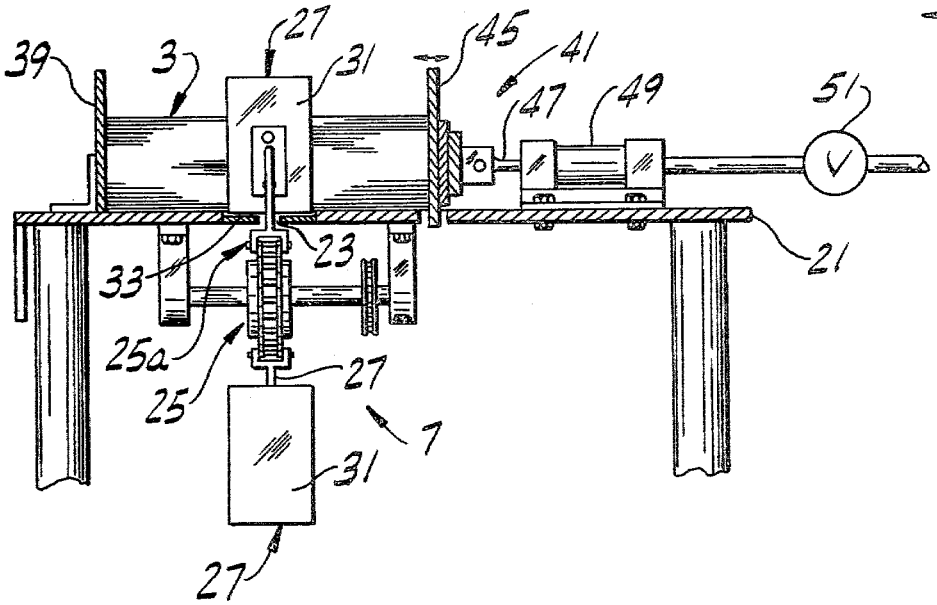
FIG. 3 is an enlarged vertical section on line 3—3 of FIG. 1.
Figure 4:
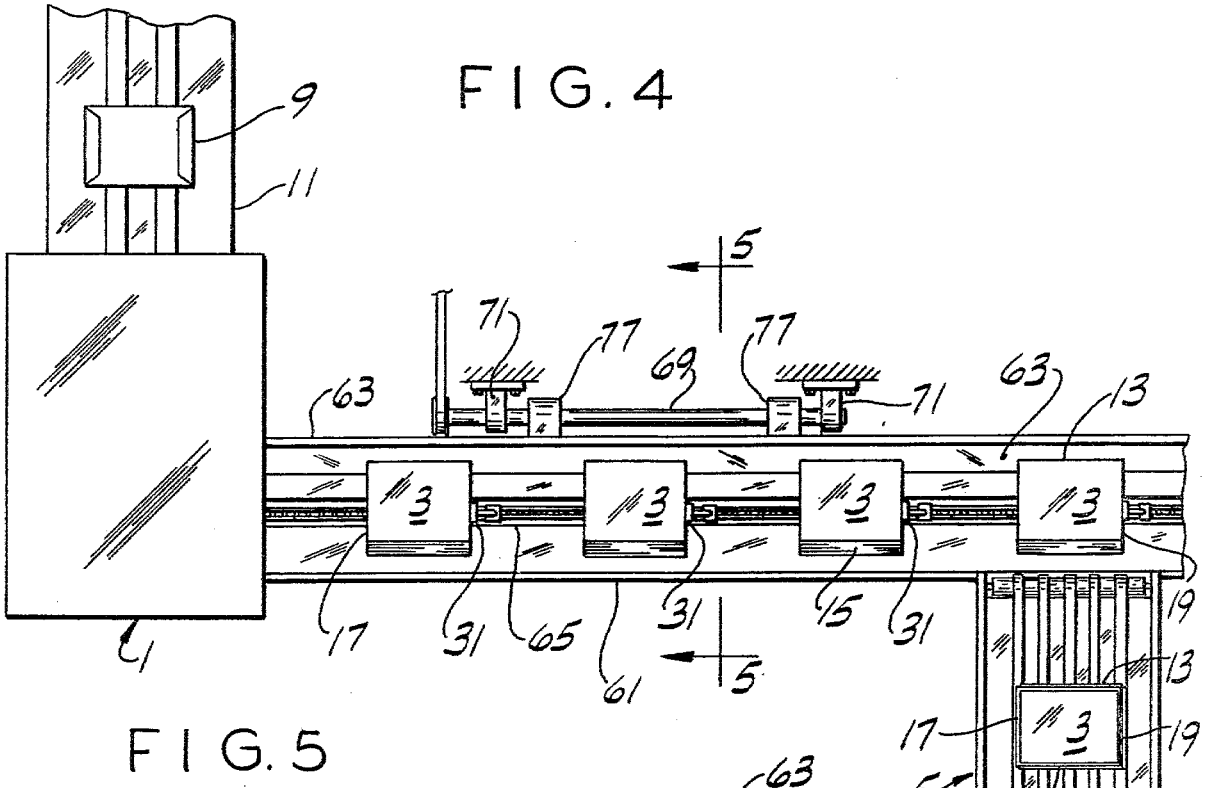
FIG. 4 is a view similar to FIG. 1 showing a second embodiment of the invention.
Figure 5:
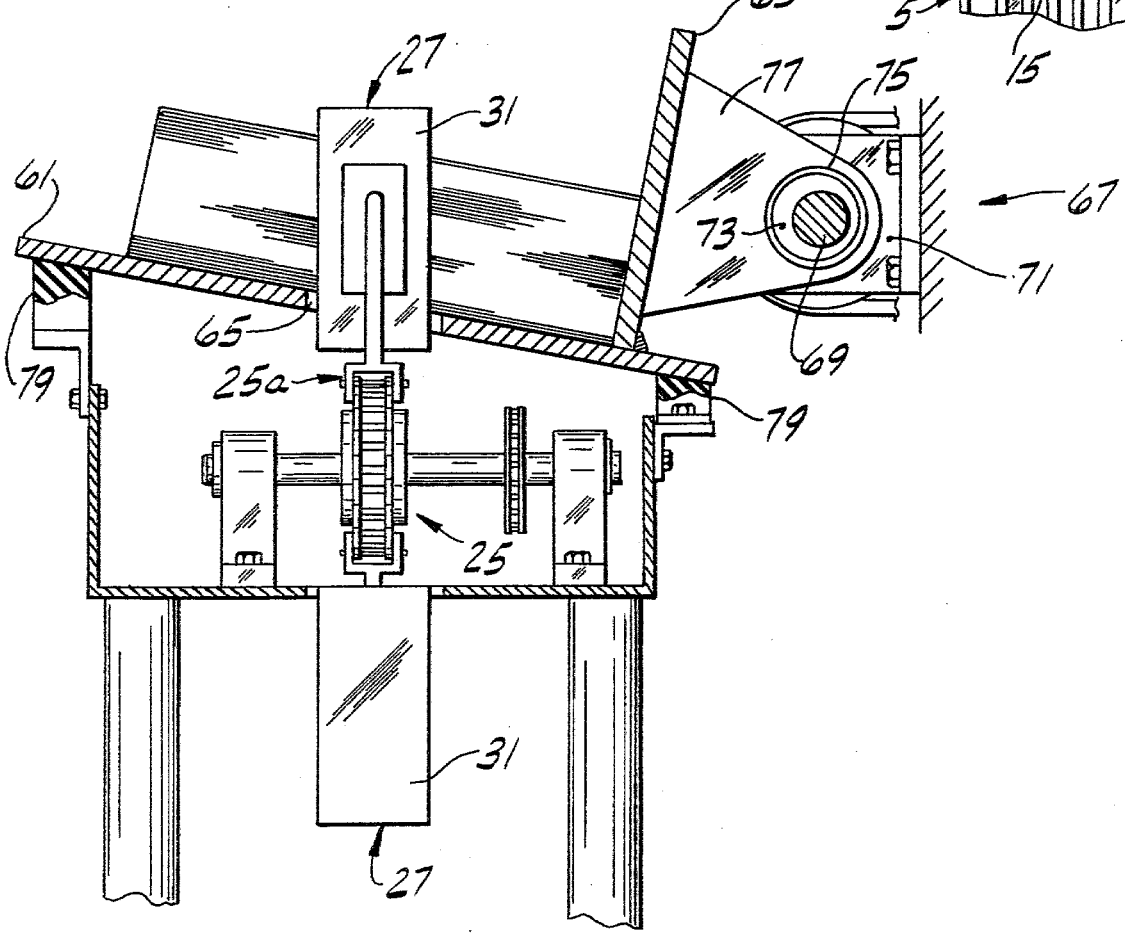
FIG. 5 is an enlarged vertical section on line 5—5 of FIG. 4.

The embodiment of the invention shown in FIGS. 1–3 is presently preferred; an alternative embodiment is shown in FIGS. 4 and 5. This is similar to the embodiment of FIGS. 1–3 with a modification of the wrapper infeed conveyor 7 to comprise a table 61 with a guide 63 fixed on the table at its right side (as viewed in downstream direction) extending in the direction of feed. The table 61 is inclined down in the direction away from the exit end of conveyor 5 toward the guide as appears in FIG. 5 with some exaggeration, and the guide 63 extends up at right angles to the inclined table. The upper reach 25*a* of the endless conveyor means 25 travels horizontally under the table 61 as in the embodiment of FIGS. 1–3 and its flights 27 are shown as extending up vertically, as before, through a slot 65 in the inclined table. Presumably they could extend at an angle off vertical like the guide 63. Means indicated at 67 is provided for shaking the entire assembly of the table 61 and the guide 63 transversely to the direction of feed of the reams on the table 61 for applying the requisite force to the reams for squaring up reams being pushed forward along the table. This means may comprise, for example, a drive shaft 69 mounted in bearings 71 adapted to be driven continuously by a motor via a speed reducer (not shown), having eccentrics 73 thereon rotary in bearings 75 in brackets 77 on the outside of the guide 63. Suitable resilient supporting means such as indicated at 79 is provided for supporting the table 61 for oscillation of the table and the guide 63 by the eccentrics. The shaking of the table and the guide brings whatever sheets of a ream being pushed forward along the table which may have been out of transverse register back into transverse register against the guide, and any sheets which may have been out of longitudinal register are brought back into longitudinal register against the pusher plate 31 which is pushing them.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. Apparatus for feeding reams of paper to a wrapping apparatus and squaring up the reams as they are fed comprising means for feeding the reams forward one after another with two opposite sides of each ream extending generally in the direction of feed and the other two opposite sides extending generally transversely of the direction of feed, said feeding means comprising a conveyor having a stationary surface over which the reams may be pushed, endless conveyor means having a series of pushers thereon adapted to extend up above the reams at the rear of the reams for pushing the reams over said surface, said endless conveyor means being movable continuously relative to said surface for continuous delivery of reams of paper to the wrapping apparatus, and means engageable with at least one of said two opposite sides of each ream for subjecting each ream being pushed forward by said pushers to forces applied repetitively transversely of the ream thereby to attain register of the sheets of the ream in the transverse direction, with the frictional resistance between the sheets of the ream as the latter is pushed forward and said means applying the force being effective to bring the sheets back against a respective pusher thereby to attain register of the sheets of the ream in the longitudinal direction.

2. Apparatus as set forth in claim 1 wherein the means for feeding the reams forward further comprises a guide having a stationary surface extending in the direction of feed at one side of the conveyor for engagement by one side of each ream as it is fed forward, the means for applying the force being at the opposite side of the conveyor and comprising means for tapping the opposite side of the ream in the direction toward said stationary surface for engagement of the ream with said surface thereby to attain register of the sheets in the transverse direction against said surface.

3. Apparatus as set forth in claim 2 wherein the means for applying the force comprises a plate engageable with said opposite side of the ream and means for shaking the plate in the direction transverse to the direction of feed.

4. Apparatus as set forth in claim 1 wherein said stationary surface comprises a table having a guide thereon at one side extending in the direction of feed, the table being inclined down toward the guide so that each ream may gravitate toward the guide, the means for applying the force being operable to shake the table and the guide thereon transversely to the direction of feed.

* * * * *